United States Patent [19]

Walsworth

[11] Patent Number: 4,473,340

[45] Date of Patent: Sep. 25, 1984

[54] COMBINED FLUID PRESSURE ACTUATED FUEL AND OIL PUMP

[75] Inventor: Frank J. Walsworth, Waukegan, Ill.

[73] Assignee: Outboard Marine Corporation, Waukegan, Ill.

[21] Appl. No.: 314,224

[22] Filed: Oct. 23, 1981

Related U.S. Application Data

[63] Continuation-in-part of Ser. No. 309,558, Oct. 8, 1981, Pat. No. 4,381,741, Continuation-in-part of Ser. No. 309,558, Oct. 8, 1981, Pat. No. 4,381,741.

[51] Int. Cl.[3] ..... F04B 43/06

[52] U.S. Cl. ..... 417/274; 417/380; 417/401; 417/523; 91/224; 91/229; 123/73 AD

[58] Field of Search ..... 123/73 AD, 196 R; 417/380, 401, 274, 523; 91/224, 229, 401, 429; 60/370, 407, 409, 411, 397; 92/60.5

[56] References Cited

U.S. PATENT DOCUMENTS

| | | | |
|---|---|---|---|
| 2,214,922 | 9/1940 | Ericson | 60/370 |
| 3,605,556 | 9/1971 | Erdmann | 91/224 X |
| 3,765,802 | 10/1973 | Leitermann et al. | 417/503 X |
| 3,913,551 | 10/1975 | Shaver | 123/73 AD X |
| 3,938,425 | 2/1976 | Kroffke | 417/274 X |
| 4,026,468 | 5/1977 | Tinder et al. | 417/523 X |
| 4,165,759 | 8/1979 | Tucker | 91/224 X |

FOREIGN PATENT DOCUMENTS

| | | | |
|---|---|---|---|
| 2139932 | 2/1973 | Fed. Rep. of Germany | 417/380 |

*Primary Examiner*—Leonard E. Smith

*Attorney, Agent, or Firm*—Michael, Best & Friedrich

[57] ABSTRACT

Disclosed herein is a combined fuel and oil pump comprising a reciprocally movable member for pumping fuel in response to member reciprocation, a reciprocally movable element for pumping oil in response to element reciprocation, and a fluid pressure actuated motor connected to the member and to the element and responsive to a source of alternating relatively high and low pressures for effecting reciprocation of the member and the element at a frequency less than the frequency of the alternation of the relatively high and low pressures.

44 Claims, 1 Drawing Figure

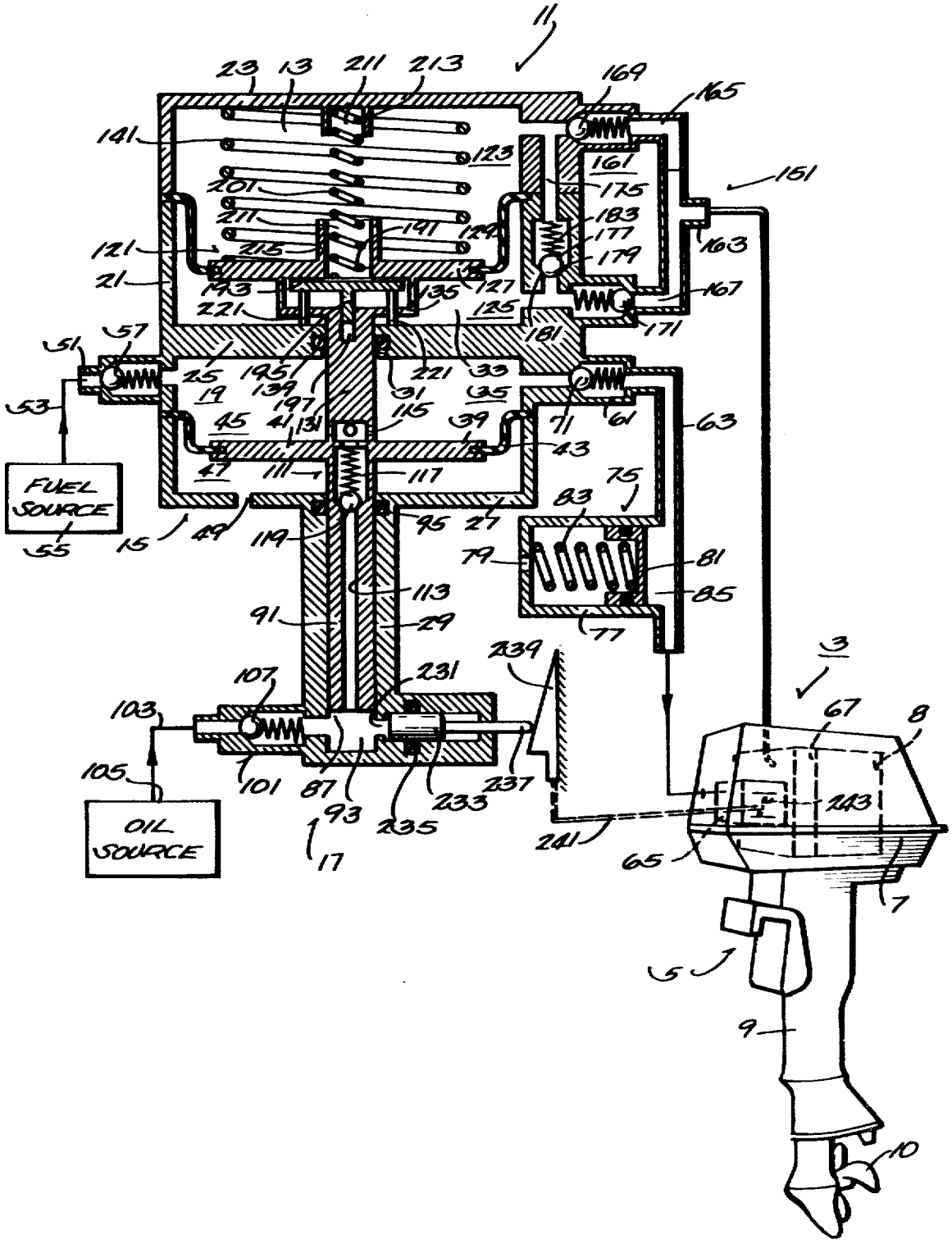
FUEL SOURCE
OIL SOURCE

COMBINED FLUID PRESSURE ACTUATED FUEL AND OIL PUMP

RELATED APPLICATION

This application is a continuation in part of my earlier application Ser. No. 309,558 filed Oct. 8, 1981, now U.S. Pat. No. 4,381,741, and entitled Mechanical Fuel Pressure Operated Device for Supplying a Fuel/Oil Mixture.

BACKGROUND OF THE INVENTION

The invention relates generally to fuel pumping arrangements.

The invention also generally relates to oil pumping arrangements.

The invention also relates generally to fluid pressure actuated motors.

The invention also relates to internal combustion engines and, more particularly, to two-stroke internal combustion engines and to means for supplying such engines with a fuel/oil mixture.

Attention is directed to the Perlewitz U.S. Pat. No. 2,935,057 issued May 30, 1960, to the Sparrow U.S. Pat. No. 3,481,318 issued Dec. 2, 1969, to the Leitermann U.S. Pat. No. 3,653,784 issued Apr. 4, 1972, to the Shaver U.S. Pat. No. 3,913,551 issued Oct. 21, 1975 and to the Schreier U.S. Pat. No. 4,142,486 issued Mar. 6, 1979.

SUMMARY OF THE INVENTION

The invention provides a combined fuel and oil pump comprising means including a reciprocally movable member for pumping fuel in response to reciprocation of the member, means including a reciprocally movable element for pumping oil in response to reciprocation of the element, and motor means connected to the member and to the element and responsive to a source of alternating relatively high and low pressures for effecting reciprocation of the member and the element at a frequency less than the frequency of the alternation of the relatively high and low pressures.

The invention also provides a fluid pressure actuated motor which can be the motor means of the combined fuel and oil pump and which comprises a housing, a motor piston movable reciprocally in the housing and dividing the housing into a relatively low pressure chamber and a relatively high pressure chamber, means biasing the motor piston so as to displace the motor piston in the direction minimizing the volume of one of the pressure chambers and maximizing the volume of the other of the pressure chambers, means for creating a fluid pressure differential between the high and low pressure chambers so as to displace the motor piston in the direction minimizing the volume of the other pressure chamber and maximizing the volume of the one pressure chamber, means responsive to motor piston movement minimizing the volume of the other pressure chamber for establishing communication between the low and high pressure chambers so as thereby to reduce the pressure differential between the high and low pressure chambers and thereby permit displacement of the motor piston by the biasing means in the direction minimizing the volume of the one pressure chamber and maximizing the volume of the other pressure chamber, and means responsive to motor piston movement minimizing the volume of the one pressure chamber for discontinuing communication between the high and low pressure chambers so as to thereby permit the creation of fluid pressure differential between the high and low pressure chambers by the fluid pressure differential creating means and thereby effect displacement of the motor piston in the direction minimizing the volume of the other pressure chamber and maximizing the volume of the one pressure chamber.

In one embodiment in accordance with the invention, the motor piston, the fuel pumping member and the oil pumping element constitute an integral component.

In one embodiment of the invention, the oil pumping means includes oil discharge means including a valved bore extending in the component between the oil pumping chamber and the fuel pumping chamber.

In one embodiment of the invention, the oil pumping means, the fuel pumping means, and the motor means form parts of a single housing.

In one embodiment of the invention, the movable oil pumping element reciprocates through a given distance, and the oil pumping means includes means for varying the output thereof notwithstanding the reciprocation of the oil pumping element through the given distance.

In one embodiment in accordance with the invention, the means for creating a pressure differential between the high and low pressure chambers comprises means adapted to be connected to a source of alternating relatively high and low pressures and including means permitting flow from the low pressure chamber and preventing flow to the low pressure chamber, and means permitting flow to the high pressure chamber and preventing flow from the high pressure chamber.

In one embodiment in accordance with the invention, the motor also includes pressure relief means connected between the high and low pressure chambers to limit the pressure differential there between.

In one embodiment in accordance with the invention, the means for establishing and disconnecting communication between the high and low pressure chambers includes a port in the motor piston, a valve member movable relative to the port between open and closed positions, means biasing the valve member away from the port, and means on the housing engageable with the valve member to close the port in response to piston movement minimizing the volume of the high pressure chamber.

Other features and advantages of the embodiments of the invention will become known by reference to the following general description, claims and appended drawings.

IN THE DRAWINGS

FIG. 1 is a schematic view of one embodiment of a combined fuel and oil pump including a fluid pressure actuated motor.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in the drawings in a marine propulsion device in the form of an outboard motor 3 which includes a propulsion unit 5 including a power head 7 incorporating a two-stroke internal combustion engine 8, together with a lower unit 9 which is secured to the power head 7 and which rotatably supports a propeller 10 driven by the internal combustion engine 8.

Connected to the internal combustion engine 8 is a combined fuel and oil pump 11 including a fluid pressure motor 13 actuated by a source of alternating relatively high and low pressures.

More particularly, the combined fuel and oil pump 11 comprises a housing 15 and, in addition to the fluid pressure motor 13, includes an oil pumping means 17 and a fuel pumping means 19.

Still more particularly, the housing 15 includes a peripheral wall 21, together with a top wall 23, an intermediate wall or partition 25, a bottom wall 27, and a lower extension 29. The intermediate wall 25 includes a central bore or port 31 and divides the housing 15 into an upper compartment 33 and a lower compartment 35.

The fuel pumping means 19 includes a movable wall member 39 which is located in the lower compartment 35 and which divides the lower compartment 35 into a variable volume fuel pumping chamber 45 located between the intermediate wall 25 and the fuel pumping piston or movable wall or member 39 and a lower or vent chamber 47 which communicates with the atmosphere through a port 49 in the bottom wall 27. The movable wall or member 39 includes a piston 41 which, at its periphery, has attached thereto a flexible membrane or diaphragm 43 which, in turn, is attached to the peripheral wall 21 of the housing 15.

The fuel pumping means 19 also includes, in the peripheral wall 21, a valved fuel inlet 51 which is adapted to communicate through a conduit 53 with a suitable source 55 of fuel and which includes one-way check valve means 57 affording inflow of fuel in response to an increase in the volume of the fuel pumping chamber 45 and which prevents outflow of fuel from the fuel pumping chamber 45.

The fuel pumping means 19 also includes, in the peripheral wall 21, a valved fuel outlet 61 which is adapted to communicate through a conduit 63 with a device, such as a carburetor 65, for feeding a fuel/oil mixture to the crankcase 67 of the two-stroke engine 8. The valved outlet 61 includes one-way check valve means 71 which affords outflow of fuel in response to a decrease in the volume of the fuel pumping chamber 45 and which prevents inflow of fuel.

Preferably, the conduit 63 includes an accumulator 75 in the form of a cylinder 77 which, at one end, communicates with the conduit 63 and which, at the other or outer end, is vented to the atmosphere by a port 79. Located in the cylinder 77 is a piston 81 which is suitably biased by a spring 83 in the direction toward the conduit 63 so as to provide a variable volume accumulating chamber 85 which serves to reduce or eliminate pulsing of fuel at the discharge end of the conduit 63.

The oil pumping means 17 is located in the lower extension 29 and comprises a cylindrical space 87 which extends from the vent chamber 47 in generally aligned relation to the central port 31 in the intermediate wall 25. Located in the cylindrical space 87 is an oil pumping plunger or element 91 which preferably extends integrally from the fuel pumping piston 41, which is reciprocal in the cylindrical space 87, and which, in part, defines a variable volume oil pumping chamber. Seal means 95 is provided between the oil pumping plunger or element 91 and the wall of the cylindrical space 87.

The oil pumping means 17 also includes a valved inlet 101 which is adapted to communicate through a conduit 103 with a source 105 of oil and which includes one-way check valve means 107 which affords inflow of oil in response to an increase in the volume of the oil pumping chamber 93 and which prevents outflow of oil.

The oil pumping means 17 also includes a valved outlet 111. While various other arrangements can be employed, in the illustrated construction, the outlet 111 is designed to deliver oil to the fuel pumping chamber 45. More particularly, the oil outlet 111 comprises a bore 113 which extends axially in the oil pumping plunger or element 91, which, at one end, communicates with the oil pumping chamber 93, which, at the other end, includes one or more radial branch ports 115 which communicate with the fuel pumping chamber 45, and which includes, intermediate the inlet 101 and the outlet 111, an enlarged central portion 117 having a one way check valve means 119 which affords outflow of fuel to the fuel pumping chamber 45 in response to a decrease in the volume of the oil pumping chamber 93 and which prevents inflow into the oil pumping chamber 93.

The fluid pressure actuated motor 13 is located generally in the upper compartment 33 and is connected to the oil pumping plunger 91 and to the fuel pumping piston 41 so as to effect common reciprocation thereof through a given stroke or distance. More particularly, the fluid pressure actuated motor 13 is responsive to a source of alternating relatively high and low pressure for effecting reciprocating of the fuel pumping piston 41 and the oil pumping plunger or element 91 at a frequency less than the frequency of the alternation of the relatively high and low pressures. Still more particularly, the fluid pressure actuated motor 13 includes a movable wall 121 which divides the upper compartment 33 into an upper, relatively low pressure variable volume chamber 123 and a lower, relatively high pressure variable volume chamber 125. The movable wall 121 includes a central or motor piston 127 which, at its outer periphery, is connected to a flexible membrane or diaphragm 129 which, at its outer periphery, is secured to the peripheral housing wall 21 so as to divide the upper compartment 33 into the before-mentioned relatively low and high pressure chambers.

The central motor piston 127 is also preferably integrally connected with the fuel pumping piston 41 and with the oil pumping plunger or element 91 for common movement. In this last regard, the combined motor piston 127, fuel pumping piston 41, and oil pumping plunger 91 includes a central portion 131 which extends from the fuel pumping piston 41 toward the motor piston 127 and through the central bore or port 31 in the intermediate wall 25, and a connecting portion which forms an open valve cage 135 and which connects the central portion 131 to the motor piston 127. A suitable seal 139 is provided between the intermediate wall 25 and the central portion 131.

The fluid pressure actuated motor 13 further includes means biasing the movable wall 121 so as to displace the movable wall 121 in the direction minimizing the volume of the high pressure chamber 125 and maximizing the volume of the low pressure chamber 123. In the illustrated construction, such means comprises a helical spring 141 which, at one end, bears against the upper or top housing wall 23 and which, at the other end, bear against the motor piston 127.

The fluid pressure actuated motor 13 also includes means 151 for creating a pressure differential between the low and high pressure chambers 123 and 125, respectively, so as to displace the movable wall 121 in the direction minimizing the volume of the low pressure chamber 123 and maximizing the volume of the high pressure chamber 125. while various arrangements can be employed, in the illustrated construction, such means includes means adapted for connection to a source of alternating relatively high and low pressures and including means permitting flow from the low pressure chamber 123 and preventing flow to the low pressure chamber 123, and means permitting flow to the high pressure chamber 125 and preventing flow from the high pressure chamber 125.

Preferably, the source of alternating relatively high and low pressures is the crankcase 67 of the two-stroke engine 8. However, other sources of relatively high and low pressures can be employed. In addition, relatively high and low pressures can refer to two positive pressures above atmospheric pressure, to two negative pressures below atmospheric pressure, or to one positive pressure above atmospheric pressure and one negative pressure below atmospheric pressure.

Still more specifically, the means 151 for creating the pressure differential between the relatively low and high pressure cylinders 123 and 125, respectively, also includes a conduit system 161 including a main conduit 163 adapted to be connected to the source of alternating high and low pressures, such as the crankcase 67 of the two-stroke engine 8, together with a first or low pressure branch conduit 165 which communicates between the low pressure chamber 123 and the main conduit 163 and a second or high pressure branch conduit 167 which communicates between the high pressure chamber 125 and main conduit 163.

Included in the low pressure branch conduit 165 is a one-way check valve 169 which permits flow from the low pressure chamber 123 and prevents flow to the low pressure chamber 123. Located in the high pressure branch conduit 167 is a one way check valve 171 which permits flow to the high pressure chamber 125 and which prevents flow from the high pressure chamber 125.

Accordingly, alternating pressure pulses of relatively high and low pressures present in the main conduit 163 will cause the existence of a relatively high pressure in the high pressure chamber 125 and a relatively low pressure in the low pressure chamber 123, which pressure differential is of sufficient magnitude, as compared to the biasing action of the movable wall biasing spring 141, so that the pressure differential is effective to cause movement of the movable wall 121 from a position in which the high pressure chamber 125 is at a minimum volume to a position in which low pressure chamber 123 is at a minimum volume.

Preferably, the conduit system 161 also includes means for relieving an excessive pressure differential. In this regard, the conduit system 161 includes a bypass conduit 175 which communicates with the low and high pressure branch conduits 165 and 167, respectively, so as to be in direct communication with the low and high pressure chambers 123 and 125, respectively. The bypass conduit 175 includes a one-way pressure regulating valve 177 including a ball member 179 which is engaged with a seat 181 and held in such engagement by a spring 183 designed to release the ball member 179 from engagement with the seat 181 in the event of an excessive differential pressure.

The fluid pressure actuated motor 13 also includes means responsive to piston movement minimizing the volume of the low pressure chamber 123 for establishing communication between the low and high pressure chambers 123 and 125, respectively, so as thereby to reduce or minimize the pressure differential between the low and high pressure chambers 123 and 125, respectively, and thereby permit displacement of the movable wall 121 by the biasing spring 141 in the direction minimizing the volume of the high pressure chamber 125 and maximizing the volume of the low pressure chamber 123. While such means can be provided, at least in part, by a conduit (not shown) bypassing the motor piston 127, in the illustrated construction, such means comprises a central port 191 in the motor piston 127, together with a valve member 193 which is located in the open cage 135 of the combined motor piston 127, fuel pumping piston 41 and oil pumping plunger 91, and which is movable between a closed and an open position. Preferably, the valve member 193 includes a downwardly extending stem 195 which is received in a mating recess or axial bore 197 in the central portion 131 of the combined piston so as to guide movement of the valve member 193 between its open and closed position.

In addition, the means for effecting communication between the low and high pressure chambers 123 and 125, respectively, includes a helical valve member biasing spring 201 which urges the valve member 193 to the open position and which, at one end, bears against the upper or top wall 23 of the housing 15 and which, at the other end, extends through the port 191 in the motor piston 127 and bears against the upper surface of the valve member 193. The valve member biasing spring 201 is designed so as to be operable to overcome the pressure differential between the low and high pressure chambers 123 and 125, respectively, and thereby to displace the valve member 193 toward the open position as the motor piston 127 approaches the position minimizing the volume of the low pressure chamber 123.

Means are also provided for insuring full opening movement of the valve member 193 in response to approach of the motor piston 127 to the piston minimizing the volume of the low pressure chamber 123. Such means is provided in the low pressure chamber 123 and comprises means defining an intermediate chamber 211 communicating with the motor piston port 191 and providing resistance to flow from the intermediate chamber 211 to the low pressure chamber 123 upon initial opening of the valve member 193 so as thereby to effect reduction in the pressure differential between the high pressure chamber 125 and the intermediate chamber 211 and thereby to cause movement of the valve member 193 to the fully opened position. Such movement substantially reduces the pressure differential between the low pressure chamber 123 and the high pressure chamber 125, and thereby permits movement of the movable wall 121 to minimize the volume of the high pressure chamber 125 in response to the action of the motor piston biasing spring 141. While various arrangements can be employed, in the illustrated construction, such means comprises an annular flange or ring 213 extending inwardly of the low pressure chamber 123 from the top wall 23 of the housing 15 and in radially outward relation from the valve member biasing spring 201 and in radially inward relation from the motor piston biasing spring 141. In addition, such means comprises a cooperating annular flange or ring 215 extending from the motor piston 127 toward the housing top wall 23 and movable into telescopic relation to the flange or ring 213 as the motor piston 127 approaches the end of the stroke minimizing the volume of the low pressure chamber 123 so as to telescopically form the intermediate chamber 211 and to provide resistance to flow from the intermediate chamber 211 to the low pressure chamber 123.

Such resistance to flow between the intermediate chamber 211 and the low pressure chamber 123 causes diminishment in the resistance to flow or pressure drop between the high pressure chamber 125 and the intermediate chamber 211, thereby assuring action of the valve member biasing spring 201 to effect displacement of the valve member 193 to its fully open position.

The fluid pressure actuated motor 13 also includes means responsive to piston movement minimizing the volume of the high pressure chamber 125 for discontinuing communication between the low and high pressure chambers 123 and 125, respectively, so as to thereby permit the creation of fluid pressure differential between the low and high pressure chambers 123 and 125 by the fluid pressure differential creating means and thereby also to effect displacement of the motor piston 127 in the direction minimizing the volume of the low pressure chamber 123 and maximizing the volume of the high pressure chamber 125. While other arrangements can be employed, in the illustrated construction, such means comprises a plurality of studs or posts 221 which extend upwardly from the intermediate partition or wall 25 toward the valve member 193 and through the open valve cage 135 for engagement with the valve member 193 to seat the valve member 193 in the closed position as the motor piston 127 approaches the position minimizing the volume of the high pressure chamber 125.

Thus, in operation, the presence of alternating high and low pressures in the conduit system 161 causes (assuming the valve member 193 to be in the closed position) buildup and maintenance of higher pressure in the relatively high pressure chamber 125 and reduction and maintenance of low pressure in the low pressure chamber 123. The pressure differential thus created causes displacement of the movable wall 121, including the motor piston 127, against the action of the motor piston biasing spring 141, to the position minimizing the volume of the low pressure chamber 123. As the motor piston 127 approaches the position minimizing the volume of the low pressure chamber 123, the valve member biasing spring 201 serves to open the motor piston port 191 by displacing the valve member 193 to the open position and thereby to reduce or minimize the pressure differential and permit displacement of the movable wall 121 by action of the biasing spring 141 to the position minimizing the volume of the high pressure chamber 125. During such movement, and in the absence of a pressure differential, the valve member 193 remains in the open position under the action of the valve member biasing spring 201.

Upon approach of the movable wall 121, including the motor piston 127, to the position minimizing the volume of the high pressure chamber 125, the studs 221 engage the valve member 193 to cause movement thereof to the closed position. With the motor piston port 191 thus closed, the pressure differential is again created and the movable wall 121 is again displaced in the opposite direction to commence another cycle of operation. As the fuel pumping 41 and the oil pumping plunger 91 have common movement with the motor piston 127, the fluid actuated motor 13 causes reciprocation of these components at a frequency less than the frequency exciting the motor 13, i.e., less than the rate of alternation of the high and low pressures in the source.

Preferably, means are provided for selectively adjusting the discharge rate of the oil pumping means 17, notwithstanding displacement of the oil pumping plunger 91 through a generally constant stroke. While various other arrangements can be employed, in the illustrated construction, such means comprises a subchamber 231 which extends from the oil pumping chamber chamber 93 and which includes therein a floating piston 233. A suitable seal 235 is provided between the floating piston 233 and the wall of the subchamber 231. The floating piston 233 includes, at the outer end thereof, a portion 237 which extends outwardly of the subchamber 231 and which is engaged by a cam 239 which is connected by a suitable linkage 241 shown in dotted outline to the engine throttle 243 and which is, accordingly, selectively positionable in accordance with selective positioning of the engine throttle 243. The cam 239 thus variably restricts outward movement of the floating piston 233 so as to thereby control the effective pumping stroke of the oil pumping plunger 91. A more detailed description of the arrangement for varying the discharge rate of the oil pumping means 17 can be found in my co-pending application Ser. No. 324,145 which is incorporated herein by reference.

The combined fuel and oil pumping device 11 can be mounted to the block of the two-stroke engine 8 so as to afford immediate connection to the engine crankcase 67 and can be connected to remote sources of oil and fuel. Alternately, if desired, the combined fuel pump and oil pump 11 can be located at a remote location more or less adjacent to or with the sources of fuel and oil and a conduit (not shown) can extend between the crankcase 67, or other source of alternating high and low pressures, and the combined fuel and oil pumping device 11.

Various of the features of the invention are set forth in the following claims.

I claim:

1. A fluid pressure actuated motor comprising a housing closed to the atmosphere, a motor piston movable reciprocally in said housing and dividing said housing into a relatively low pressure chamber and a relatively high pressure chamber, means biasing said motor piston so as to displace said motor piston in the direction minimizing the volume of one of said pressure chambers and maximizing the volume of the other of said pressure chambers, means responsive to the application of alternating relatively high and low pressures to said high and low pressure chambers for creating a fluid pressure differential between said high and low pressure chambers so as to displace said motor piston in the direction minimizing the volume of said other pressure chamber and maximizing the volume of said one pressure chamber, means responsive to motor piston movement minimizing the volume of said other pressure chamber for establishing communication between said low and high pressure chambers so as thereby to reduce the pressure differential between said high and low pressure chambers and thereby permit displacement of said motor piston by said biasing means in the direction minimizing the volume of said one pressure chamber and maximizing the volume of said pressure chamber, and means responsive to motor piston movement minimizing the volume of said one pressure chamber for discontinuing communication between said high and low pressure chambers so as to thereby permit the creation of fluid pressure differential between said high and low pressure chambers by said fluid pressure differential creating means and thereby effect displacement of said motor piston in the direction minimizing the volume of said other pressure chamber and maximizing the volume of said one pressure chamber.

2. A fluid pressure actuated motor comprising a housing closed to the atmosphere, a motor piston movable reciprocally in said housing and dividing said housing into a relatively low pressure chamber and a relatively high pressure chamber, said motor piston including an output portion, means biasing said motor piston so as to displace said motor piston in the direction minimizing the volume of one of said pressure chambers and maximizing the volume of the other of said pressure chambers, means for creating a fluid pressure differential between said high and low pressure chambers so as to displace said motor piston in the direction minimizing the volume of said other pressure chamber and maximizing the volume of said one pressure chamber, said means for creating a pressure differential between said high and low pressure chambers comprising means adapted to be connected to a source of alternating relatively high and low pressures and including means permitting flow from said low pressure chamber and preventing flow to said low pressure chamber, and means permitting flow to said high pressure chamber and preventing flow from said high pressure chamber, means responsive to motor piston movement minimizing the volume of said other pressure chamber for establishing communication between said low and high pressure chambers so as thereby to reduce the pressure differential between said high and low pressure chambers and thereby permit displacement of said motor piston by said biasing means in the direction minimizing the volume of said one pressure chamber and maximizing the volume of said other pressure chamber, and means responsive to motor piston movement minimizing the volume of said one pressure chamber for discontinuing communication between said high and low pressure chambers so as to thereby permit the creation of fluid pressure differential between said high and low pressure chambers by said fluid pressure differential creating means and thereby effect displacement of said motor piston in the direction minimizing the volume of said other pressure chamber and maximizing the volume of said one pressure chamber.

3. A fluid pressure actuated motor comprising a housing closed to the atmosphere, a motor piston movable reciprocally in said housing and dividing said housing into a relatively low pressure chamber and a relatively high pressure chamber, said motor piston including a output portion, means biasing said motor piston so as to displace said motor piston in the direction minimizing the volume of one of said pressure chambers and maximizing the volume of the other of said pressure chambers, means for creating a fluid pressure differential between said high and low pressure chambers so as to displace said motor piston in the direction minimizing the volume of said other pressure chamber and maximizing the volume of said one pressure chamber, means responsive to motor piston movement minimizing the volume of said other pressure chamber for establishing communication between said low and high pressure chambers so as thereby to reduce the pressure differential between said high and low pressure chambers and thereby permit displacement of said motor piston by said biasing means in the direction minimizing the volume of said one pressure chamber and maximizing the volume of said other pressure chamber, means responsive to motor piston movement minimizing the volume of said one pressure chamber for discontinuing communication between said high and low pressure chambers so as to thereby permit the creation of fluid pressure differential between said high and low pressure chambers by said fluid pressure differential creating means and thereby effect displacement of said motor piston in the direction minimizing the volume of said other pressure chamber and maximizing the volume of said one pressure chamber, and pressure relief means connected between said high and low pressure chambers to limit the pressure differential therebetween.

4. A fluid pressure actuated motor comprising a housing closed to the atmosphere, a motor piston movable reciprocally in said housing and dividing said housing into a relatively low pressure chamber and a relatively high pressure chamber, means biasing said motor piston so as to displace said motor piston in the direction minimizing the volume of one of said pressure chambers and maximizing the volume of the other of said pressure chambers, means responsive to the application of alternating relatively high and low pressures to said high and low pressure chambers for creating a fluid pressure differential between said high and low pressure chambers so as to displace said motor piston in the direction minimizing the volume of said other pressure chamber and maximizing the volume of said one pressure chamber, means responsive to motor piston movement minimizing the volume of said other pressure chamber for establishing communication between said low and high pressure chambers so as thereby to reduce the pressure differential between said high and low pressure chambers and thereby permit displacement of said motor piston by said biasing means in the direction minimizing the volume of said one pressure chamber and maximizing the volume of said other pressure chamber, and means responsive to motor piston movement minimizing the volume of said one pressure chamber for discontinuing communication between said high and low pressure chambers so as to thereby permit the creation of fluid pressure differential between said high and low pressure chambers by said fluid pressure differential creating means and thereby effect displacement of said motor piston in the direction minimizing the volume of said other pressure chamber and maximizing the volume of said one pressure chamber, said means for establishing and disconnecting communication between said high and low pressure chambers including a port in said motor piston, a valve member movable relative to said port between said open and closed positions, means biasing said valve member away from said port, and means on said housing engageable with said valve member to close said port in response to piston movement minimizing the volume of said one pressure chamber.

5. A fluid pressure actuated motor in accordance with claim 4 wherein said means responsive to motor piston movement minimizing the volume of said other pressure chamber for establishing communication between said low and high pressure chambers so as thereby to reduce the pressure differential between said high and low pressure chambers and thereby permit displacement of said motor piston by said biasing means in the direction minimizing the volume of said one pressure chamber and maximizing the volume of said other pressure chamber comprises said port in said motor piston communicating between said low and high pressure chambers, said valve member which is movable between open and closed positions, whereby, when said valve member is in said closed position, and a pressure differential is created between said low and high pressure chambers, said motor piston is operable against the action of said motor piston biasing means so as to minimize the volume of said other pressure chamber, and said means biasing said valve member away from said port, which biasing means is operable, in response to motor piston movement minimizing the volume of said other pressure chamber, to displace said valve member toward said open position so as to permit limited flow from said high pressure chamber to said low pressure chamber when said valve member biasing means exerts a force which is slightly greater than the force resulting from the pressure differential between said low and high pressure chambers, and means in said other pressure chamber operable, in response to motor piston movement minimizing the volume of said other pressure chamber, to define an intermediate chamber communicating with said port and providing resistance to flow from said intermediate chamber to said other pressure chamber so as thereby to effect reduction in the pressure differential between said one pressure chamber and said intermediate chamber and thereby to cause movement of said valve member to said open position, whereby to substantially reduce the pressure differential between said low and high pressure chambers, and thereby to cause motor piston movement minimizing the volume of said one pressure chamber in response to the action of said motor piston biasing means.

6. A fluid pressure actuated motor comprising a housing closed to the atmosphere, a motor piston movable reciprocally in said housing through a given distance and dividing said housing into a relatively low pressure chamber and a relatively high pressure chamber, said motor piston including an output portion, means biasing said motor piston so as to displace said motor piston in the direction minimizing the volume of one of said pressure chambers and maximizing the volume of the other of said pressure chambers, means for creating a fluid pressure differential between said high and low pressure chambers so as to displace said motor piston in the direction minimizing the volume of said other pressure chamber and maximizing the volume of said one pressure chamber, means responsive to motor piston movement minimizing the volume of said other pressure chamber for establishing communication between said low and high pressure chambers so as thereby to reduce the pressure differential between said high and low pressure chambers and thereby permit displacement of said motor piston by said biasing means in the direction minimizing the volume of said one pressure chamber and maximizing the volume of said other pressure chamber, means responsive to motor piston movement minimizing the volume of said one pressure chamber for discontinuing communication between said high and low pressure chambers so as to thereby permit the creation of fluid pressure differential between said high and low pressure chambers by said fluid pressure differential creating means and thereby effect displacement of said motor piston in the direction minimizing the volume of said other pressure chamber and maximizing the volume of said one pressure chamber, and means including a reciprocally movable element for pumping oil in response to reciprocation of said element, said movable element being reciprocable through said given distance, and said oil pumping means including means for varying the output thereof notwithstanding the reciprocation of said element through said given distance.

7. A fluid pressure actuated motor comprising a housing closed to the atmosphere, a motor piston movable reciprocally in said housing and dividing said housing into a relatively low pressure chamber and a relatively high pressure chamber, said motor piston including an output portion, means biasing said motor piston so as to displace said motor piston in the direction minimizing the volume of one of said pressure chambers and maximizing the volume of the other of said pressure chambers, means for creating a fluid pressure differential between said high and low pressure chambers so as to displace said motor piston in the direction minimizing the volume of said other pressure chamber and maximizing the volume of said one pressure chamber, means responsive to motor piston movement minimizing the volume of said other pressure chamber for establishing communication between said low and high pressure chambers so as thereby to reduce the pressure differential between said high and low pressure chambers and thereby permit displacement of said motor piston by said biasing means in the direction minimizing the volume of said one pressure chamber and maximizing the volume of said other pressure chamber, means responsive to motor piston movement minimizing the volume of said one pressure chamber for discontinuing communication between said high and low pressure chambers so as to thereby permit the creation of fluid pressure differential between said high and low pressure chambers by said fluid pressure differential creating means and thereby effect displacement of said motor piston in the direction minimizing the volume of said other pressure chamber and maximizing the volume of said one pressure chamber, fuel pumping means comprising a reciprocally movable member, and a variable volume fuel pumping chamber defined in part by said movable member, and oil pumping means including a reciprocally movable element, and a variable volume oil pumping chamber defined in part by said movable element, and wherein said motor piston, said member, and said element constitute an integral component.

8. A fluid pressure actuated motor in accordance with claim 7 wherein said oil pumping means includes oil discharge means including a valved bore extending in said component between said oil pumping chamber and said fuel pumping chamber.

9. A fluid pressure actuated motor comprising a housing, a motor piston movable reciprocally in said housing and dividing said housing into a relatively low pressure chamber and a relatively high pressure chamber, means biasing said motor piston so as to displace said motor piston in the direction minimizing the volume of one of said pressure chambers and maximizing the volume of the other of said pressure chambers, means for creating a fluid pressure differential between said high and low pressure chambers so as to displace said motor piston in the direction minimizing the volume of said other pressure chamber and maximizing the volume of said one pressure chamber, said means for creating a pressure differential between said high and low pressure chambers comprising means adapted to be connected to a source of alternating relatively high and low pressures and including means permitting flow from said low pressure chamber and preventing flow to said low pressure chamber, and means permitting flow to said high pressure chamber and preventing flow from said high pressure chamber, means responsive to motor piston movement minimizing the volume of said other pressure chamber for establishing communication between said low and high pressure chambers so as thereby to reduce the pressure differential between said high and low pressure chambers and thereby permit displacement of said motor piston by said biasing means in the direction minimizing the volume of said one pressure chamber and maximizing the volume of said other pressure chamber, and means responsive to motor piston movement minimizing the volume of said one pressure chamber for discontinuing communication between said high and low pressure chambers so as to thereby permit the creation of fluid pressure differential between said high and low pressure chambers by said fluid pressure differential creating means and thereby effect displacement of said motor piston in the direction minimizing the volume of said other pressure chamber and maximizing the volume of said one pressure chamber.

10. A fluid pressure actuated motor comprising a housing, a motor piston movable reciprocally in said housing and dividing said housing into a relatively low pressure chamber and a relatively high pressure chamber, means biasing said motor piston so as to displace said motor piston in the direction minimizing the volume of one of said pressure chambers and maximizing the volume of the other of said pressure chambers, means for creating a fluid pressure differential between said high and low pressure chambers so as to displace said motor piston in the direction minimizing the volume of said other pressure chamber and maximizing the volume of said one pressure chamber, means responsive to motor piston movement minimizing the volume of said other pressure chamber for establishing communication between said low and high pressure chambers so as thereby to reduce the pressure differential between said high and low pressure chambers and thereby permit displacement of said motor piston by said biasing means in the direction minimizing the volume of said one pressure chamber and maximizing the volume of said other pressure chamber, means responsive to motor piston movement minimizing the volume of said one pressure chamber for discontinuing communication between said high and low pressure chambers so as to thereby permit the creation of fluid pressure differential between said high and low pressure chambers by said fluid pressure differential creating means and thereby effect displacement of said motor piston in the direction minimizing the volume of said other pressure chamber and maximizing the volume of said one pressure chamber, and pressure relief means connected between said high and low pressure chambers to limit the pressure differential therebetween.

11. A fluid pressure actuated motor comprising a housing, a motor piston movable reciprocally in said housing and dividing said housing into a relatively low pressure chamber and a relatively high pressure chamber, means biasing said motor piston so as to displace said motor piston in the direction minimizing the volume of one of said pressure chambers and maximizing the volume of the other of said pressure chambers, means responsive to the application of alternating relatively high and low pressures to said high and low pressure chambers for creating a fluid pressure differential between said high and low pressure chambers so as to displace said motor piston in the direction minimizing the volume of said other pressure chamber and maximizing the volume of said one pressure chamber, and means responsive to motor piston movement minimizing the volume of said other pressure chamber for establishing communication between said low and high pressure chambers so as thereby to reduce the pressure differential between said high and low pressure chambers and thereby permit displacement of said motor piston by said biasing means in the direction minimizing the volume of said one pressure chamber and maximizing the volume of said other pressure chamber, and means responsive to motor piston movement minimizing the volume of said one pressure chamber for discontinuing communication between said high and low pressure chambers so as to thereby permit the creation of fluid pressure differential between said high and low pressure chambers by said fluid pressure differential creating means and thereby effect displacement of said motor piston in the direction minimizing the volume of said other pressure chamber and maximizing the volume of said one pressure chamber, said means for establishing and disconnecting communication between said high and low pressure chambers including a port in said motor piston, a valve member movable relative to said port between open and closed positions, means biasing said valve member away from said port, and means on said housing engageable with said valve member for closing said port in response to piston movement minimizing the volume of said one pressure chamber.

12. A fluid pressure actuated motor in accordance with claim 11 wherein said means responsive to motor piston movement minimizing the volume of said other pressure chamber for establishing communication between said low and high pressure chambers so as thereby to reduce the pressure differential between said high and low pressure chambers and thereby permit displacement of said motor piston by said biasing means in the direction minimizing the volume of said one pressure chamber and maximizing the volume of said other pressure chamber comprises said port in said motor piston communicating between said low and high pressure chambers, said valve member which is movable between open and closed positions, whereby, when said valve member is in said closed position and a pressure differential is created between said low and high pressure chambers, said motor piston is operable against the action of said motor piston biasing means so as to minimize the volume of said other pressure chamber, and said means biasing said valve member away from said ports said biasing means being operable in response to motor piston movement minimizing the volume of said other pressure chamber, to displace said valve member toward said open position so as to permit limited flow from said high pressure chamber to said low pressure chamber when said valve member biasing means exerts a force which is equal to, or slightly greater than, the force resulting from the pressure differential between said low and high pressure chambers, and means in said other pressure chamber operable, in response to motor piston movement minimizing the volume of said other pressure chamber, to define an intermediate chamber communicating with said port and providing resistance to flow from said intermediate chamber to said other pressure chamber so as thereby to effect reduction in the pressure differential between said one pressure chamber and said intermediate chamber and thereby to cause movement of said valve member to said open position, whereby to substantially reduce the pressure differential between said low and high pressure chambers, and thereby to cause motor piston movement minimizing the volume of said one pressure chamber in response to the action of said motor piston biasing means.

13. A fluid pressure actuated motor comprising a housing, a motor piston movable reciprocally in said housing through a given distance and dividing said housing into a relatively low pressure chamber and a relatively high pressure chamber, said motor piston including an output portion, means biasing said motor piston so as to displace said motor piston in the direction minimizing the volume of one of said pressure chambers and maximizing the volume of the other of said pressure chambers, means for creating a fluid pressure differential between said high and low pressure chambers so as to displace said motor piston in the direction minimizing the volume of said other pressure chamber and maximizing the volume of said one pressure chamber, means responsive to motor piston movement minimizing the volume of said other pressure chamber for establishing communication between said low and high pressure chambers so as thereby to reduce the pressure differential between said high and low pressure chambers and thereby permit displacement of said motor piston by said biasing means in the direction minimizing the volume of said one pressure chamber and maximizing the volume of said other pressure chamber, means responsive to motor piston movement minimizing the volume of said one pressure chamber for discontinuing communication between said high and low pressure chambers so as to thereby permit the creation of fluid pressure differential between said high and low pressure chambers by said fluid pressure differential creating means and thereby effect displacement of said motor piston in the direction minimizing the volume of said other pressure chamber and maximizing the volume of said one pressure chamber, means including an element operably connected to said output portion of said motor piston and movable reciprocally through said given distance for pumping oil in response to reciprocation of said element, said oil pumping means including means for varying the output thereof notwithstanding the reciprocation of said element through said given distance.

14. A fluid pressure actuated motor comprising a housing, a motor piston movable reciprocally in said housing and dividing said housing into a relatively low pressure chamber and a relatively high pressure chamber, said motor piston including an output portion, means biasing said motor piston so as to displace said motor piston in the direction minimizing the volume of one of said pressure chambers and maximizing the volume of the other of said pressure chambers, means for creating a fluid pressure differential between said high and low pressure chambers so as to displace said motor piston in the direction minimizing the volume of said other pressure chamber and maximizing the volume of said one pressure chamber, means responsive to motor piston movement minimizing the volume of said other pressure chamber for establishing communication between said low and high pressure chambers so as thereby to reduce the pressure differential between said high and low pressure chambers and thereby permit displacement of said motor piston by said biasing means in the direction minimizing the volume of said one pressure chamber and maximizing the volume of said other pressure chamber, means responsive to motor piston movement minimizing the volume of said one pressure chamber for discontinuing communication between said high and low pressure chambers so as to thereby permit the creation of fluid pressure differential between said high and low pressure chambers by said fluid pressure differential creating means and thereby effect displacement of said motor piston in the direction minimizing the volume of said other pressure chamber and maximizing the volume of said one pressure chamber, means for pumping fuel including a reciprocally movable member operably connected to said output portion of said motor piston, and a variable volume fuel pumping chamber defined in part by said movable member, and means for pumping oil including a reciprocally movable element operably connected to said output portion of said motor piston, and a variable volume oil pumping chamber defined in part by said movable element, said motor piston, said member, and said element constituting an integral component.

15. A fluid pressure actuated motor in accordance with claim 14 wherein said oil pumping means includes oil discharge means including a valved bore extending in said component between said oil pumping chamber and said fuel pumping chamber.

16. A fluid pressure actuated motor comprising housing, a motor piston movable reciprocally in said housing and dividing said housing into a relatively low pressure chamber and a relatively high pressure chamber, means biasing said motor piston so as to displace said motor piston in the direction minimizing the volume of one of said pressure chambers and maximizing the volume of the other of said pressure chambers, means for creating a fluid pressure differential between said high and low pressure chambers so as to displace said motor piston in the direction minimizing the volume of said other pressure chamber and maximizing the volume of said one pressure chamber, said means for creating a pressure differential between said high and low pressure chambers comprising means permitting flow from said other pressure chamber and preventing flow to said other pressure chamber, means responsive to motor piston movement minimizing the volume of said other pressure chamber for establishing communication between said low and high pressure chambers so as thereby to reduce the pressure differential between said high and low pressure chambers and thereby permit displacement of said motor piston by said biasing means in the direction minimizing the volume of said one pressure chamber and maximizing the volume of said other pressure chamber, means responsive to motor piston movement minimizing the volume of said one pressure chamber for discontinuing communication between said high and low pressure chambers so as to thereby permit the creation of fluid pressure differential between said high and low pressure chambers by said fluid pressure differential creating means and thereby effect displacement of said motor piston in the direction minimizing the volume of said other pressure chamber and maximizing the volume of said one pressure chamber.

17. A combined fuel and oil pump comprising means including a reciprocally movable member for pumping fuel in response to reciprocation of said member, means including a reciprocally movable element for pumping oil in response to reciprocation of said element, and motor means connected to said member and to said element and responsive to a source alternating relatively high and low pressures for effecting reciprocation of said member and said element at a frequency less than the frequency of the alternation of the relatively high and low pressures.

18. A combined fuel and oil pump in accordance with claim 17 wherein said motor means includes a movable piston, wherein said fuel pumping means includes a variable volume fuel pumping chamber defined in part by said movable member, wherein said oil pumping means includes a variable volume oil pumping chamber defined in part by said movable element and wherein said motor piston, said member and said element constitute an integral component.

19. A combined fuel and oil pump in accordance with claim 18 wherein said oil pumping means includes oil discharge means including a valved bore extending in said component between said oil pumping chamber and said fuel pumping chamber.

20. A combined fuel and oil pump in accordance with claim 17 wherein said oil pumping means, said fuel pumping means, and said motor means form parts of a single housing.

21. A combined fuel and oil pump in accordance with claim 17 wherein said fuel pumping means includes a variable volume pumping chamber defined in part by said movable member and wherein said oil pumping means includes discharge means communicating with said variable volume fuel pumping chamber.

22. A combined fuel and oil pump in accordance with claim 17 wherein said movable element reciprocates through a given distance, and wherein said oil pumping means includes means for varying the output thereof notwithstanding the reciprocation of said element through said given distance.

23. A combined fuel and oil pump in accordance with claim 17 wherein said motor means comprises a housing, a motor piston movable reciprocally in said housing and dividing said housing into a relatively low pressure chamber and a relatively high pressure chamber, means biasing said motor piston so as to displace said motor piston in the direction minimizing the volume of said high pressure chamber and maximizing the volume of said low pressure chamber, means for creating a fluid pressure differential between said high and low pressure chambers so as to displace said motor piston in the direction minimizing the volume of said low pressure chamber and maximizing the volume of said high pressure chamber, means responsive to motor piston movement minimizing the volume of said low pressure chamber for establishing communication between said low and high pressure chambers so as thereby to reduce the pressure differential between said high and low pressure chambers and thereby permit displacement of said motor piston by said biasing means in the direction minimizing the volume of said high pressure chamber and maximizing the volume of said low pressure chamber, and means responsive to motor piston movement minimizing the volume of said high pressure chamber for discontinuing communication between said high and low pressure chambers so as to thereby permit the creation of fluid pressure differential between said high and low pressure chambers by said fluid pressure differential creting means and thereby effect displacement of said motor piston in the direction minimizing the volume of said low pressure chamber and maximizing the volume of said high pressure chamber.

24. A combined fuel and oil pump in accordance with claim 23 wherein said means for creating a pressure differential between said high and low pressure chambers comprises means adapted to be connected to a source of alternating relatively high and low pressures and including means permitting flow from said low pressure chamber and preventing flow to said low pressure chamber, and means permitting flow to said high pressure chamber and preventing flow from said high pressure chamber.

25. A combined fuel and oil pump in accordance with claim 23 wherein said motor also includes pressure relief means connected between said high and low pressure chambers to limit the pressure differential therebetween.

26. A combined fuel and oil pump in accordance with claim 23 wherein said motor piston reciprocates through a given distance, wherein said movable element reciprocates through said given distance, and wherein said oil pumping means includes means for varying the output thereof notwithstanding the reciprocation of said element through said given distance.

27. A combined fuel and oil pump in accordance with claim 23 wherein said means for establishing and disconnecting communication between said high and low pressure chambers includes a port in said motor piston, a valve member movable relative to said port between open and closed positions, means biasing said valve member away from said port, and means on said housing engageable with said valve member to close said port in response to piston movement minimizing the volume of said high pressure chamber.

28. A combined fuel and oil pump in accordance with claim 27 wherein said means responsive to motor piston movement minimizing the volume of said low pressure chamber for establishing communication between said low and high pressure chambers so as thereby to reduce the pressure differential between said high and low pressure chambers and thereby permit displacement of said motor piston by said biasing means in the direction maximizing the volume of said low pressure chamber and minimizing the volume of said high pressure chamber comprises said port in said motor piston communicating between said low and high pressure chambers, said valve member which is movable between open and closed positions whereby, when said valve member is in said closed position, and a pressure differential is created between said low and high pressure chambers, said motor piston is operable against the action of said motor piston biasing means so as to minimize the volume of said low pressure chamber, said means biasing valve member away from said port, which biasing means is operable, in response to motor piston movement minimizing the volume of said low pressure chamber, to displace said valve member toward said open position so as to permit limited flow from said high pressure chamber to said low pressre chamber when said valve member biasing means exerts a force which is equal to, or slightly greater than, the force resulting from the pressure differential between said low and high pressure chambers, and means in said low pressure chamber operable, in response to motor piston movement minimizing the volume of said low pressure chamber, to define an intermediate communicating with said port and providing resistance to flow from said intermediate chamber to said low pressure chamber so as thereby to effect reduction in the pressure differential between said high pressure chamber and said intermediate chamber and thereby to cause movement of said valve member to said open position, whereby to substantially reduce the pressure differential between said low and high pressure chambers, and thereby to cause motor piston movement minimizing the volume of said high pressure chamber in response to the action of said motor piston biasing means.

29. A combined fuel and oil pump in accordance with claim 26 wherein said fuel pumping means includes a variable volume fuel pumping chamber defined in part by said movable member, wherein said oil pumping means includes a variable volume oil pumping chamber defined in part by said movable element, and wherein said motor piston, said member and said element constitute an integral component.

30. A combined fuel and oil pump in accordance with claim 24 wherein said oil pumping means includes oil discharge means including a valved bore extending in said component between said oil pumping chamber and said fuel pumping chamber.

31. A combined fuel and oil pump comprising means including a reciprocally movable member for pumping fuel in response to reciprocation of said member, means including a reciprocally movable element for pumping oil in response to reciprocation of said element, and motor means connected to said member and to said element and responsive to a source of alternating relatively high and low pressures for effecting reciprocation of said member and said element at a frequency less than the frequency of the alternation of the relatively high and low pressures, said motor means including relatively low and high pressure chambers which inversely vary in volume, and means for creating a pressure differential between said high and low pressure chambers comprising means adapted to be connected to a source of alternating relatively high and low pressures and including means permitting flow from said low pressure chamber and preventing flow to said low pressure chamber, and means permitting flow to said high pressure chamber and preventing flow from said high pressure chamber.

32. A combined fuel and oil pump in accordance with claim 31 wherein said oil pumping means includes oil discharge means including a valved bore extending in said component between said oil pumping chamber and said fuel pumping chamber.

33. A combined fuel and oil pump in accordance with claim 31 wherein said oil pumping means, said fuel pumping means, and said motor means form parts of a single housing.

34. A combined fuel and oil pump in accordance with claim 31 wherein said fuel pumping means includes a variable volume pumping chamber defined in part by said movable member, and wherein said oil pumping means includes discharge means communicating with said variable volume fuel pumping chamber.

35. A combined fuel and oil pump in accordance with claim 31 wherein said movable element reciprocates through a given distance, and wherein said oil pumping means includes means for varying the output thereof notwithstanding the reciprocation of said element through said given distance.

36. A combined fuel and oil pump in accordance with claim 31 wherein said motor means comprises a housing closed to the atmosphere, a motor piston movable reciprocally in said housing and dividing said housing into a relatively low pressure chamber and a relatively high pressure chamber, means biasing said motor piston so as to displace said motor piston in the direction minimizing the volume of said high pressure chamber and maximizing the volume of said low pressure chamber, means for creating a fluid pressure differential between said high and low pressure chambers so as to displace said motor piston in the direction minimizing the volume of said low pressure chamber and maximizing the volume of said high pressure chamber, means responsive to motor piston movement minimizing the volume of said low pressure chamber for establishing communication between said low and high pressure chambers so as thereby to reduce the pressure differential between said high and low pressure chambers and thereby permit displacement of said motor piston by said biasing means in the direction minimizing the volume of said high pressure chamber and maximizing the volume of said low pressure chamber, and means responsive to motor piston movement minimizing the volume of said high pressure chamber for discontinuing communication between said high and low pressure chambers so as to thereby permit the creation of a fluid pressure differential between said high and low pressure chambers by said fluid pressure differential creating means and thereby effect displacement of said motor piston in the direction minimizing the volume of said low pressure chamber and maximizing the volume of said high pressure chamber.

37. A fluid pressure actuated motor comprising a housing, a motor piston movable reciprocally in said housing and dividing said housing into a relatively low pressure chamber and a relatively high pressure chamber, said motor piston including an output portion, means biasing said motor piston so as to displace said motor piston in the direction minimizing the volume of one of said pressure chambers and maximizing the volume of the other of said pressure chambers, means for creating a fluid pressure differential between said high and low pressure chambers so as to displace said motor piston in the direction minimizing the volume of said other pressure chamber and maximizing the volume of said one pressure chamber, said means for creating a pressure differential between said high and low pressure chambers including means permitting flow from said low pressure chamber and preventing flow to said low pressure chamber, and means permitting flow to said high pressure chamber and preventing flow from said high pressure chamber, means responsive to motor piston movement minimizing the volume of said other pressure chamber for establishing communication between said low and high pressure chambers so as thereby to reduce the pressure differential between said high and low pressure chambers and thereby permit displacement of said motor piston by said biasing means in the direction minimizing the volume of said one pressure chamber and maximizing the volume of said other pressure chamber, and means responsive to motor piston movement minimizig the volume of said one pressure chamber for discontinuing communication between said high and low pressure chambers so as to thereby permit the creation of fluid pressure differential between said high and low pressure chambers by said fluid pressure differential creating means and thereby effect displacement of said motor piston in the direction minimizing the volume of said other pressure and maximizing the volume of said one pressure chamber.

38. A fluid pressure actuated motor in accordance with claim 37 wherein said means for creating a pressure differential between said high and low pressure chambers comprises means adapted to be connected to a source of alternating relatively high and low pressures and including said means permitting flow from said low pressure chamber and preventing flow to said low pressure chamber, and said means permitting flow to said high pressure chamber and preventing flow from said high pressure chamber.

39. A fluid pressure actuated motor in accordance with claim 37 and further including pressure relief means connected between said high and low pressure chambers to limit the pressure differential therebetween.

40. A fluid pressure actuated motor in accordance with claim 37 and further including oil pumping means including a reciprocally movable element, wherein said motor piston reciprocates through a given distance, wherein said movable element reciprocates through said given distance, and wherein said oil pumping means includes means for varying the output thereof notwithstanding the reciprocation of said element through said given distance.

41. A fluid pressure actuated motor in accordance with claim 37 wherein said means for establishing and disconnecting communication between said high and low pressure chambers includes a port in said motor piston, a valve member movable relative to said port between open and closed positions, means biasing said valve member away from said port, and means on said housing engageable with said valve member to close said port in response to piston movement minimizing the volume of said one pressure chamber.

42. A fluid pressure actuated motor in accordance with claim 41 wherein said means responsive to motor piston movement minimizing the volume of said other pressure chamber for establishing communication between said low and high pressure chambers so as thereby to reduce the pressure differential between said high and low pressure chambers and thereby permit displacement of said motor piston by said biasing means in the direction minimizing the volume of said one pressure chamber and maximizing the volume of said other pressure chamber comprises said port in said motor piston communicating between said low and high pressure chambers said valve member which is movable between open and closed positions, whereby, when said valve member is in said closed position and a pressure differential is created between said low and high pressure chambers, said motor piston is operable against the action of said motor piston biasing means so as to minimize the volume of said other pressure chamber, and said means biasing said valve member away from said port, said biasing means being operable, in response to motor piston movement minimizing the volume of said other pressure chamber, to displace said valve member toward said open position so as to permit limited flow from said high pressure chamber to said low pressure chamber when said valve member biasing means exerts a force which is equal to, or slightly greater than, the force resulting from the pressure differential between said low and high pressure chambers, and means in said other pressure chamber operable, in response to motor piston movement minimizing the volume of said other pressure chamber, to define an intermediate chamber communicating with said port and providing resistance to flow from said intermediate chamber to said other pressure chamber so as thereby to effect reduction in the pressure differential between said one pressure chamber and said intermediate chamber and thereby to cause movement of said valve member to said open position, whereby to substantially reduce the pressure differential said loW and high pressure chambers, and thereby to cause motor piston movement minimizing the volume of said one pressure chamber in response to the action of said motor piston biasing means.

43. A fluid pressure actuated motor in accordance with claim 37 and including fuel pumping means including a reciprocally movable member, and a variable volume fuel pumping chamber defined in part by said movable member, oil pumping means including a reciprocally movable element, and a variable volume oil pumping chamber defined in part by said movable element, and wherein said motor piston, said member, and said element consititute an integral component.

44. A fluid pressure actuated motor in accordance with claim 43 wherein said oil pumping means includes oil discharge means including a valved bore extending in said component between said oil pumping chamber and said fuel pumping chamber.

* * * * *